US006736330B2

(12) United States Patent
Kanda

(10) Patent No.: US 6,736,330 B2
(45) Date of Patent: May 18, 2004

(54) THREE-DIMENSIONAL RUNNERS FOR TOYS AND PLAYTHINGS

(76) Inventor: Kinzo Kanda, 6-27, Doshida 4-chome, Nerima-ku, Tokyo (JP)

( * ) Notice: Subject to any disclaimer, the term of this patent is extended or adjusted under 35 U.S.C. 154(b) by 0 days.

(21) Appl. No.: 10/200,195

(22) Filed: Jul. 23, 2002

(65) Prior Publication Data

US 2003/0015593 A1 Jan. 23, 2003

(30) Foreign Application Priority Data

Jul. 23, 2001 (JP) ..... 2001-221729

(51) Int. Cl.[7] ..... E01B 23/00
(52) U.S. Cl. ..... 238/10 R
(58) Field of Search ..... 238/10 R, 10 A, 238/10 B, 10 C; 104/53

(56) References Cited

U.S. PATENT DOCUMENTS 3,359,920 A * 12/1967 Iammateo ..... 463/62
4,185,409 A * 1/1980 Cheng ..... 446/487
4,355,807 A * 10/1982 Prehodka ..... 463/63

* cited by examiner

*Primary Examiner*—S. Joseph Morano
*Assistant Examiner*—Robert J. McCarry, Jr.
(74) *Attorney, Agent, or Firm*—Connolly, Bove, Lodge & Hutz, LLP

(57) ABSTRACT

A vehicle 3 runs three-dimensionally by first pushing up a mobile ascending track directly above and running to the terminal end of a mobile track 13, then running up to the highest position by returning and moving over to another mobile track directly above, then running down by lowering a descending track 23 to another mobile track directly below under the self-weight of the running vehicle 3.

3 Claims, 4 Drawing Sheets

THREE-DIMENSIONAL RUNNERS FOR TOYS AND PLAYTHINGS

This invention relates to three-dimensional runners for toys and playthings.

The circuit toys of the type disclosed in Japanese Provisional Patent Publication No. 269574 of 1984 over which racing cars run are expensive and too large to take an encompassing view of the whole in small spaces.

On the other hand, the runners of the type disclosed in Japanese Provisional Patent Publication No. 266749 of 1986 that spirally wind up and down around a column do not require large spaces. Because of simple movements, however, the runners of this type tend to bore the spectators too soon.

SUMMARY OF THE INVENTION

The object of this invention is to provide new runners to run model and play vehicles in small spaces with varying motions.

A runner of this invention comprises an ascending route comprising at least one mobile track provided with a tendency to swing so that the start end thereof is always positioned near the terminal end of another mobile track directly below and a descending route comprising at least one mobile track connected to the uppermost mobile track of each route and adapted to swing so as to become connected to near the start end of the mobile track directly below by the self-weight of a running vehicle.

Being thus constructed, the runner of this invention, though three-dimensional, not only permits a self-running vehicle to continuously run both upward and downward but also allows safe and sure running of toy and play vehicles.

Providing a mobile descending track that swingably connects to the side of the start end of the mobile track directly below and having a curve directed to the start end of the mobile track directly below the terminal end permits still safer running without run-off by reducing the influence of the inertia of the running vehicle even when the length of the mobile track is increased.

DESCRIPTION OF PREFERRED EMBODIMENTS

Details of this invention will be described by reference to the embodiments illustrated.

Figure 1:
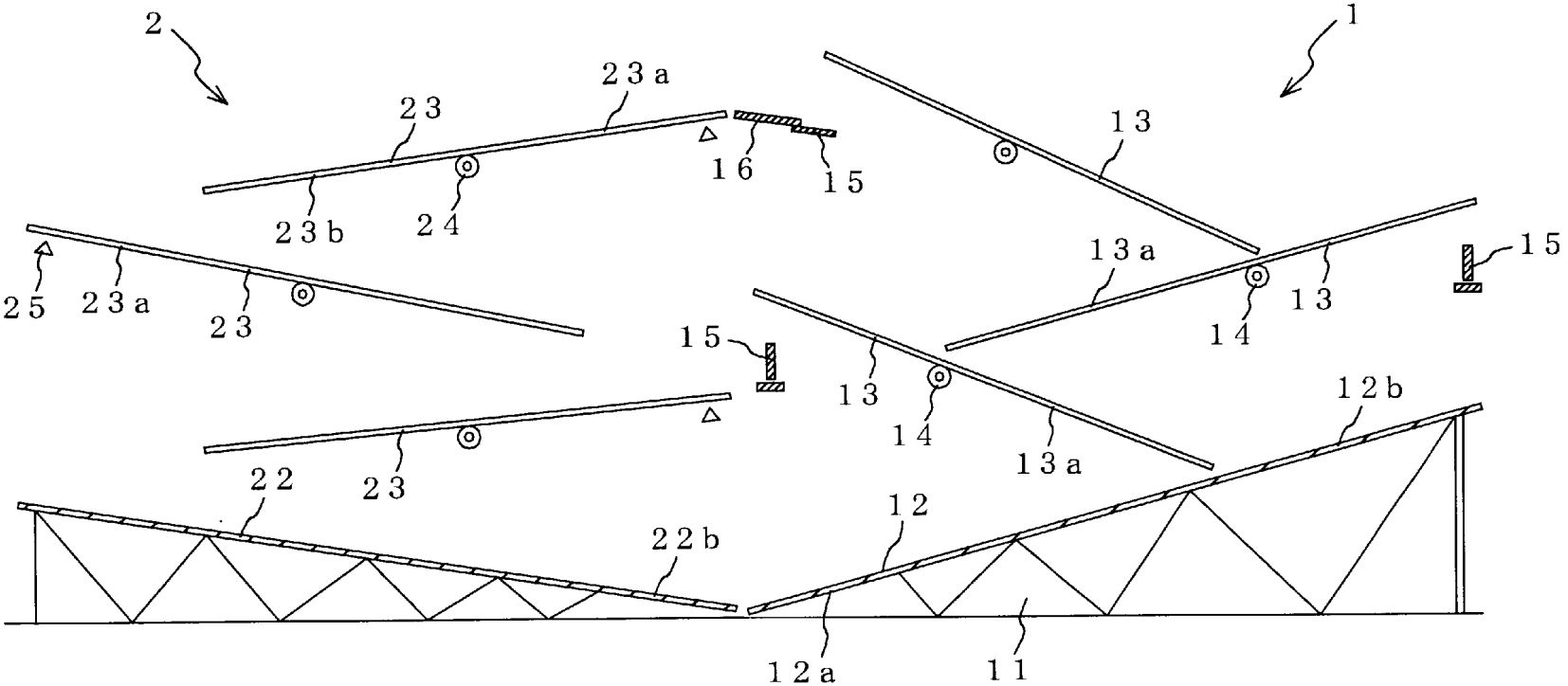
FIG. 1 is a schematic view of a typical embodiment of this inve3ntion.
Figure 2:
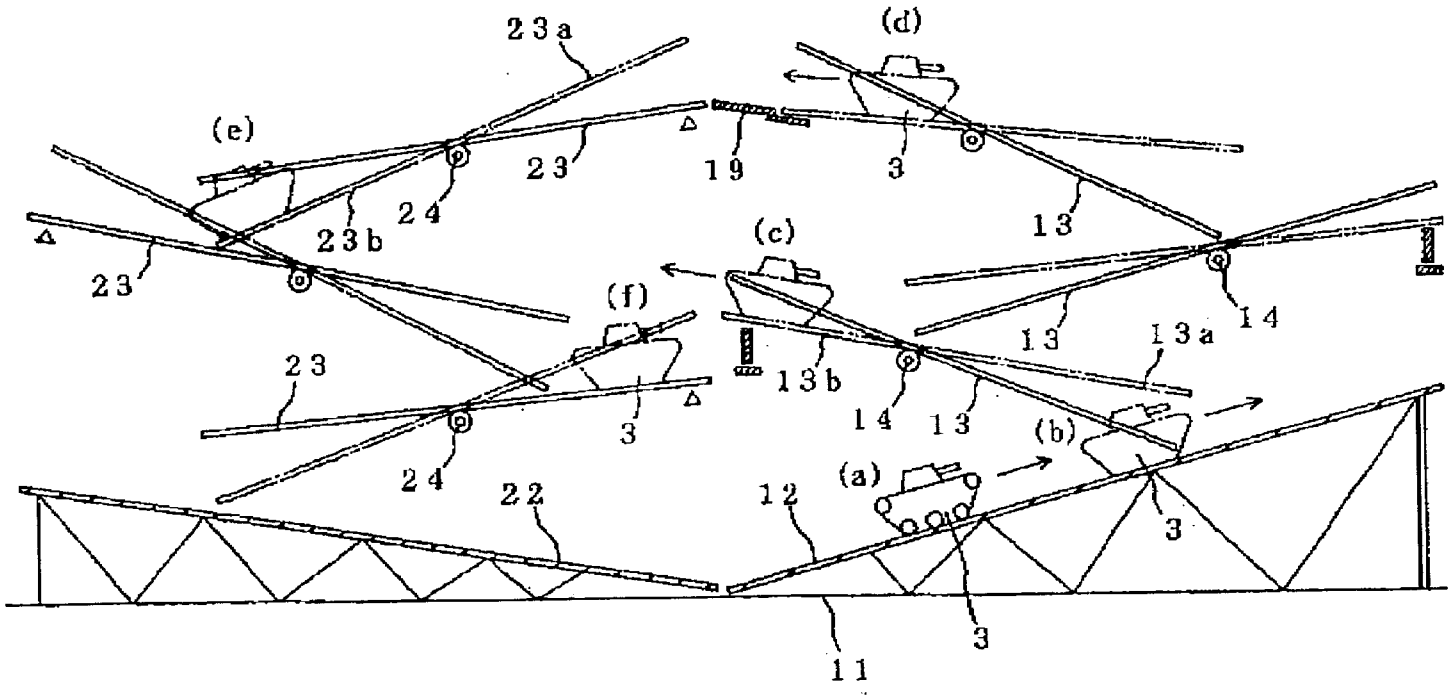
FIG. 2 shows the embodiment of FIG. 1 in operation.

FIGS. 1 and 2 show a three-dimensional runner according to this invention.

This runner is made up of a zigzag ascending route 1 comprising one or more mobile tracks 13 and a zigzag descending route 2 comprising one or more mobile tracks 23.

The ascending route 1 comprises a running track 12 fastened to a base or base plate 11 and another ascending mobile track 13 swingably positioned near the terminal end of the fastened running track 12 so as to form a reversed ascent.

The ascending mobile track 13 is a seesaw-like track that is somewhat heavier on the start end 13*a* thereof. The ascending mobile track 13 is swingably mounted on a fulcrum 14 provided at a point higher than the running vehicle 3 and is normally held tilted upward, with the start end 13*a* kept in contact with the vicinity of the terminal end 12*b*.

Another ascending track 13 of similar construction is positioned directly above said ascending track 13 so as to be swingable around a fulcrum 14 positioned at a point higher than the running vehicle 3, with the start end 13 held in contact therewith. The zigzag ascending route 1 is thus constructed by combining several ascending tracks 13.

Reference numeral 15 designates a stopper provided below the terminal end 13*a* of each mobile track 13 to regulate the motion thereof.

The zigzag descending route 2 is made up of several descending mobile tracks 23 connected to the ascending mobile tracks 13 through a connecting track 16.

The uppermost descending mobile track 23 is swingably provided, with the start end 23*a* thereof normally connected to the connecting track 16 and adapted to come in contact with the start end 23*a* of the descending mobile track 23 directly therebelow when the weight of the running vehicle 3 acts thereon.

The next descending mobile track 23 is swingably mounted on the fulcrum 24, with the somewhat heavier start end 23*a* thereof normally kept in contact with the stopper 25 and spaced away from the terminal end 23*b* thereof by a clearance equivalent to the height of the running vehicle 3.

Thus one three-dimensional runner is formed by mounting the lowermost descending mobile track 23 is on the stationary descending track 22 with a clearance equivalent to the height of the vehicle 3 left therebetween and then connecting the terminal end 22*b* of the stationary descending track 22 to the start end 12*a* of the ascending stationary track.

When the running vehicle 3 begins to ascend on the stationary ascending track 12 (a), the vehicle 3 pushes up the mobile ascending track 13 whose start end 13*a* is kept in contact with the vicinity of the terminal end 12*b* of the stationary ascending track 12 (b), reaches the terminal end 12*b* of the stationary ascending track 12, and returns therefrom.

In this condition, the mobile ascending track 13 pushed up is on standby, with the somewhat heavier start end 13*a* kept in contact with the stationary ascending track 12. Therefore, the vehicle 3 returning from the terminal end 12*b* moves onto the mobile ascending track 13, turns the same track 13 counterclockwise under its weight to the position indicated by a dot-dash line when the vehicle 3 passes the fulcrum 14, and moves further to the terminal end 13*b* (c).

Then, the vehicle 3 reaches the terminal end 13*b* of the uppermost mobile track 13 after repeating the running process mentioned above, turns the mobile track 13 counterclockwise under its own weight (d), and moves on to the lowermost mobile descending track 23 via the connecting track 16 (e).

After passing the fulcrum 24, the vehicle 3 swings down the mobile descending track 23 and moves on to the mobile descending track 23 directly below. Then, the vehicle 3 turns around with the inertia thereof cancelled by the ascending slope of the mobile track 23. The vehicle completes the running cycle when it moves on to the lowermost stationary descending track 12 after repeating the same process.

A suitable stopper, not shown, to stop the vehicle 3 is provided near the terminal ends 13*b* and 23*b* of each of the mobile tracks 13 and 23 and stationary tracks 12 and 13. A contact-type or non-contact-type switch provided at each stopper switches the drive motor of the running vehicle 3.

Figure 3:
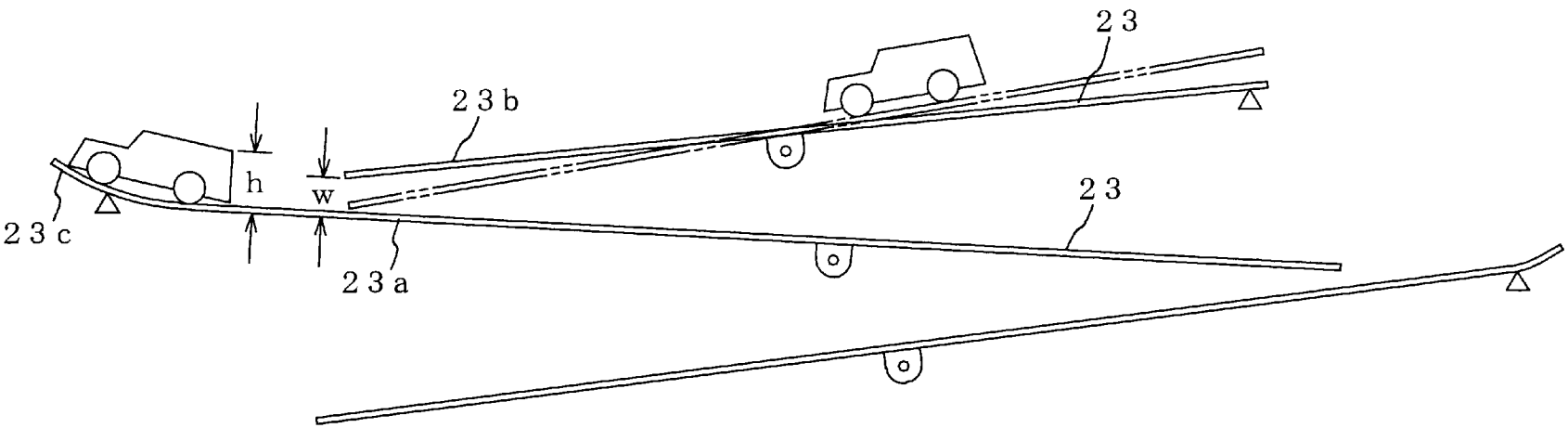
FIG. 3 is a side elevation of another embodiment of this invention used as a descending track.
Figure 4:
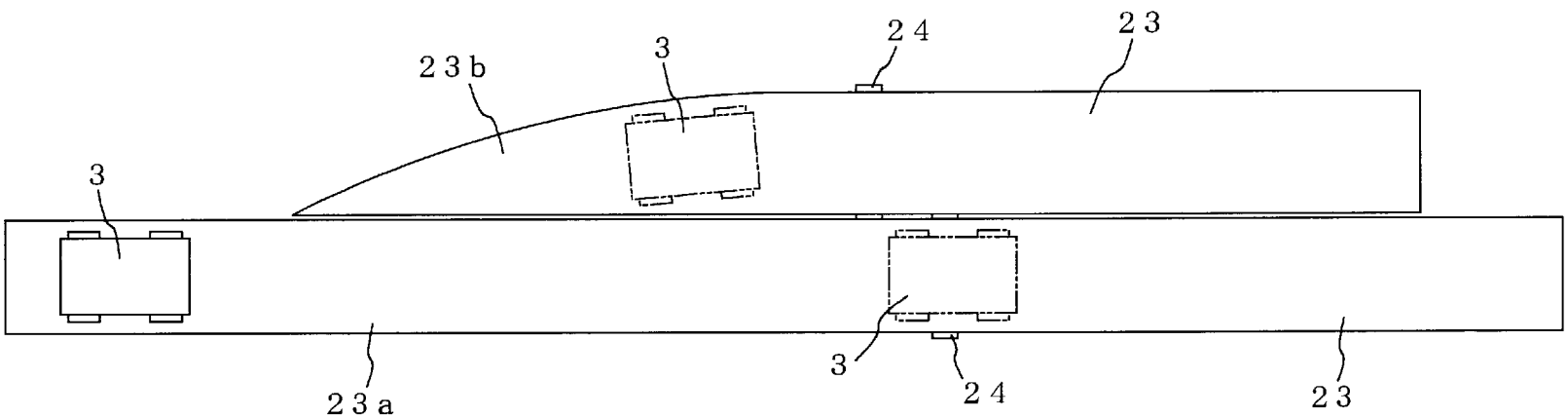
FIG. 4 is a plan view of the embodiment shown in FIG. 3.

FIGS. 3 and 4 show another embodiment of the mobile descending track 23. Though very long, the mobile descending track 23 of this type also reduces the influence of the inertia of the running vehicle 3.

The breadth of the swing w of the end of the mobile track 23 is made smaller than the height h of the running vehicle 3, thereby reducing the inclination of the track. Instead, the upper and lower mobile tracks 23 are positioned parallel and close to each other, the terminal end 23*b* of the mobile track 23 is connected to the start end of the mobile track 23 directly thereabove by means of a curved track, and an upward-curved slope 23*c* for deceleration is provided in the start end 23*a* of the mobile track 23 directly below.

What is claimed is:

1. A three-dimensional runner comprising:

an ascending route comprising at least one mobile ascending track swingably mounted on a fulcrum so that a start end of the at least one mobile ascending track is always positioned near a terminal end of another mobile ascending track directly below; and a descending route comprising at least one mobile descending track connected to an uppermost mobile track of the ascending route and an uppermost mobile track of the descending route, wherein the at least one mobile descending track is adapted to swing so as to become connected to a start end of a mobile descending track directly below by the weight of a running vehicle.

2. A three-dimensional runner according to claim 1, further comprising:

a stationery ascending track connected to a lowermost mobile ascending track; and a stationary descending track connected to a lowermost mobile descending track, wherein a start end of the station ascending track is connected to a terminal end of the stationary descending track.

3. A three-dimensional runner according to claim 1, wherein said at least one mobile descending track is adapted to become connected to the side of the start end of the mobile descending track directly below under the weight of the running vehicle, and wherein said at least one mobile descending track has a terminal end curved toward the start end of the mobile descending track directly below.

* * * * *